US009638116B2

(12) United States Patent
Vos et al.

(10) Patent No.: US 9,638,116 B2
(45) Date of Patent: May 2, 2017

(54) SYSTEM AND METHOD FOR CONTROL OF INTERNAL COMBUSTION ENGINE

(75) Inventors: David W. Vos, Delaplane, VA (US); Michael D. Piedmonte, Warrenton, VA (US); Gregory E. Mott, Fairmont, WV (US); Christopher M. Boggs, Gainesville, VA (US); Keith M. Allen, Centreville, VA (US)

(73) Assignee: Rockwell Collins Control Technologies, Inc., Warrenton, VA (US)

( * ) Notice: Subject to any disclaimer, the term of this patent is extended or adjusted under 35 U.S.C. 154(b) by 1085 days.

(21) Appl. No.: 13/810,637

(22) PCT Filed: Jul. 20, 2011

(86) PCT No.: PCT/US2011/044650

§ 371 (c)(1),
(2), (4) Date: May 28, 2013

(87) PCT Pub. No.: WO2012/012511

PCT Pub. Date: Jan. 26, 2012

(65) Prior Publication Data

US 2013/0245920 A1 Sep. 19, 2013

Related U.S. Application Data

(60) Provisional application No. 61/365,983, filed on Jul. 20, 2010.

(51) Int. Cl.

| | |
|---|---|
| ***F02D 41/00*** | (2006.01) |
| ***F02D 41/14*** | (2006.01) |
| *F02D 41/22* | (2006.01) |

(52) U.S. Cl.
CPC ..... *F02D 41/00* (2013.01); *F02D 41/1443* (2013.01); *F02D 41/1446* (2013.01); *F02D 41/1447* (2013.01); *F02D 41/222* (2013.01)

(58) Field of Classification Search
CPC ..... F02D 2001/167; F02D 2009/0222; F02D 35/025; F02D 41/024; F02D 41/0245;
(Continued)

(56) References Cited

U.S. PATENT DOCUMENTS 5,158,063 A * 10/1992 Hosoda ..... F02D 41/0235 123/672
5,278,762 A 1/1994 Kawamura
(Continued)

FOREIGN PATENT DOCUMENTS

JP EP 1431549 A2 * 6/2004 ..... F01N 3/023
JP 2004197697 A * 7/2004
WO WO 2012-012511 A1 1/2012

*Primary Examiner* — Erick Solis
*Assistant Examiner* — Anthony L Bacon
(74) *Attorney, Agent, or Firm* — Finnegan, Henderson, Farabow, Garrett & Dunner LLP

(57) ABSTRACT

A system for controlling operation of an internal combustion engine includes a controller configured to send signals for controlling at least one of air-fuel ratio, spark-ignition timing, and fuel injection timing to an internal combustion engine. The system further includes a sensor configured to send a signal indicative of exhaust gas temperature to the controller. The system is configured to control at least one of the air-fuel ratio, spark-ignition timing, and fuel injection timing based on a signal indicative of at least one of an operating condition of the internal combustion engine and load on the internal combustion engine, and a difference between a target exhaust gas temperature and the signal indicative of the exhaust gas temperature.

17 Claims, 4 Drawing Sheets

(58) Field of Classification Search
CPC ..... F02D 2041/0265; F02D 41/1444; F02D 41/1446; F02P 5/14
See application file for complete search history.

(56) References Cited

U.S. PATENT DOCUMENTS

| | | | | |
|---|---|---|---|---|
| 5,642,705 | A * | 7/1997 | Morikawa | F02B 17/005 123/300 |
| 5,983,876 | A | 11/1999 | Irons et al. | |
| 7,593,803 | B2 | 9/2009 | Healy et al. | |
| 2002/0100467 | A1 | 8/2002 | Jaliwala et al. | |
| 2004/0003805 | A1 * | 1/2004 | Ono | F02D 35/025 123/676 |
| 2004/0123741 | A1 * | 7/2004 | Ohtake | B01D 46/0063 96/420 |
| 2004/0133335 | A1 * | 7/2004 | Nakano | F01N 3/023 701/103 |
| 2009/0076709 | A1 | 3/2009 | Shiraishi et al. | |
| 2009/0283080 | A1 * | 11/2009 | Matas | F02D 41/1475 123/676 |
| 2010/0258099 | A1 * | 10/2010 | Andersson | F02D 31/006 123/676 |
| 2011/0099997 | A1 * | 5/2011 | Singh | F01N 3/0236 60/602 |
| 2011/0257871 | A1 * | 10/2011 | Takigawa | F02D 41/1446 701/104 |

* cited by examiner

SYSTEM AND METHOD FOR CONTROL OF INTERNAL COMBUSTION ENGINE

CLAIM OF PRIORITY

This application is a U.S. national stage entry under 35 U.S.C. §371 from PCT International Application No. PCT/US2011/044650, filed Jul. 20, 2011, which claims priority to and the benefit of the filing date of U.S. Provisional Application No. 61/365,983, filed Jul. 20, 2010, to both of which this application claims the benefit of priority, and the entirety of the subject matter of both of which is incorporated herein by reference.

FIELD OF THE DISCLOSURE

The present disclosure relates to a system and method for controlling an internal combustion engine. In particular, the present disclosure relates to a system and method for controlling an internal combustion engine via closed-loop control.

BACKGROUND

Internal combustion engines convert chemical energy associated with a mixture of air and fuel into mechanical power by combustion of the mixture of air and fuel. In particular, many internal combustion engines burn carbon-based fuels, such as, for example, gasoline, diesel fuel, alcohol such as methane and ethane, and/or combinations thereof, such as, for example, a gasoline-alcohol combination sometimes referred to as "E85" (i.e., a mixture of about 85% ethanol and about 15% gasoline). The combustion of carbon-based fuels converts the chemical energy associated with the carbon-based fuel into mechanical power by releasing heat generated during combustion, which, in turn, creates pressure that drives a mechanism, such as, for example, the piston of a reciprocating engine or the rotor of a rotary engine.

Along with releasing heat, combustion of the mixture of air and fuel results in the emission of by-products of the combustion process. For example, combustion may result in the emission of unburned fuel, hydrocarbons such as methane ($CH_4$), oxides of carbon ($CO_x$) such as carbon monoxide (CO) and carbon dioxide ($CO_2$), oxides of nitrogen ($NO_X$), water vapor, ozone ($O_3$), and/or other compounds. Of particular concern is the emission of "greenhouse gases," such as, for example, carbon dioxide ($CO_2$), methane ($CH_4$), ozone ($O_3$), and water vapor.

Renewed interest in the conservation of natural resources and the environment has led to an increased desire to improve the fuel efficiency and reduce the emissions of internal combustion engines. One way to increase the efficiency of internal combustion engines is to harness the maximum amount of energy associated with a unit volume of fuel during combustion by controlling the combustion process such that a greater proportion of the fuel is burned during combustion. This greater efficiency, in turn, effectively reduces the amount of exhaust emissions created during combustion by virtue of the combustion of less fuel. Further, as a greater proportion of the fuel used during operation of the internal combustion engine is completely burned, the amount of pollutants associated with the emissions fuel may be reduced.

Although a number of prior attempts have been made to obtain a more complete combustion of fuel, those attempts have suffered from a number of possible drawbacks. For example, some prior attempts have required relatively expensive control systems, rendering such systems economically unattractive for certain applications. Other attempts have been found less reliable, rendering them unsuitable for long-term use and/or some applications.

Yet another possible drawback with some prior systems relates to an inability of the systems to tailor operation of the internal combustion engine to particular operating circumstances. For example, it may be desirable under some operating circumstances for an internal combustion engine to achieve maximum efficiency at the expense of responsiveness to changes in load. Such operational circumstances may occur, for example, when the internal combustion engine is being used at a relatively steady engine speed and/or a relatively constant load, such as, for example, the operational circumstances experienced by a lawn mower, or the operational circumstances experienced by a car, boat, or airplane when cruising at a relatively constant speed and/or altitude. On the other hand, some operating circumstances may result in a desire for increased responsiveness to changes in load at the expense of maximum efficiency. Such operational circumstances may occur, for example, when the internal combustion engine is being used in a car being driven in a city's stop-and-go traffic, or in an airplane during take-off or landing operations. Thus, it may be desirable to control the operation of an internal combustion engine in an efficient manner that permits the operation to be changed based on the operating circumstances, while minimizing undesirable exhaust emissions.

SUMMARY

In the following description, certain aspects and embodiments will become evident. It should be understood that the invention, in its broadest sense, could be practiced without having one or more features of these aspects and embodiments. It should be understood that these aspects and embodiments are merely exemplary.

One aspect of the present disclosure relates to a system for controlling operation of an internal combustion engine. The system includes a controller configured to send signals for controlling at least one of air-fuel ratio, spark-ignition timing, and fuel injection timing to an internal combustion engine. The system further includes a sensor configured to send a signal indicative of exhaust gas temperature to the controller. The system is configured to control at least one of air-fuel ratio, spark-ignition timing, and fuel injection timing based on a signal indicative of at least one of an operating condition of the internal combustion engine and load on the internal combustion engine, and a difference between a target exhaust gas temperature and the signal indicative of the exhaust gas temperature.

According to another aspect, a machine includes an internal combustion engine and a system for controlling operation of the internal combustion engine. The system includes a controller configured to send signals configured to control at least one of air-fuel ratio, ignition timing, and fuel injection timing to the internal combustion engine. The system further includes a sensor configured to send a signal indicative of exhaust gas temperature to the controller. The controller is configured to control at least one of air-fuel ratio, ignition timing, and fuel injection timing based on a signal indicative of at least one of an operating condition of the internal combustion engine and load on the internal combustion engine, and a difference between a target exhaust gas temperature and the signal indicative of the exhaust gas temperature.

According to yet another aspect, a method for controlling operation of an internal combustion engine includes receiving a signal indicative of at least one of an operating condition of the internal combustion engine and load on the internal combustion engine, receiving a signal indicative of exhaust gas temperature of the internal combustion engine, and controlling at least one of air-fuel ratio, spark-ignition timing, and fuel injection timing based on the signal indicative of at least one of an operating condition and load, and a difference between the signal indicative of exhaust gas temperature and a target exhaust gas temperature.

According to still a further aspect, a method of providing data for controlling operation of an internal combustion engine includes operating an internal combustion engine and adjusting at least one of air-fuel ratio, spark-ignition timing, and fuel injection timing. The method further includes measuring a signal indicative of exhaust gas temperature, creating correlations between at least one of the air-fuel ratio, spark-ignition timing, and fuel injection timing and the exhaust gas temperature, and storing the correlations in a data storage device.

According to yet another aspect, a system for controlling operation of an internal combustion engine includes a controller configured to send signals for controlling air-fuel ratio to an internal combustion engine, and a sensor configured to send a signal indicative of exhaust gas temperature of the engine to the controller. The controller is configured to send a signal indicative of a commanded air-fuel ratio to the engine based on correlations between an operating condition of the engine, air-fuel ratio, and exhaust gas temperature stored in memory. The controller is further configured to send signals indicative of a plurality of different air-fuel ratios to the engine, such that the engine operates at each of the plurality of different air-fuel ratios. The controller is also configured to receive a plurality of signals indicative of exhaust gas temperature associated with operation of the engine at each of the plurality of different air-fuel ratios. The controller is configured to estimate a peak exhaust gas temperature associated with the operating condition based on the plurality of signals indicative of exhaust gas temperature.

According to still a further aspect, a system for controlling operation of an internal combustion engine includes a controller configured to send signals for controlling air-fuel ratio to an internal combustion engine, and a sensor configured to send a signal indicative of exhaust gas temperature of the engine to the controller. The controller is configured to send a signal indicative of a commanded air-fuel ratio to the engine based on correlations between an operating condition of the engine, air-fuel ratio, and exhaust gas temperature stored in memory. The controller is also configured to send signals indicative of a plurality of different air-fuel ratios to the engine, such that the engine operates at each of the plurality of different air-fuel ratios. The controller is further configured to receive a plurality of signals indicative of exhaust gas temperature associated with operation of the engine at each of the plurality of different air-fuel ratios. The controller is also configured to determine whether there is a fault associated with operation of one of the sensor and a fuel injector of the engine.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DESCRIPTION OF EXEMPLARY EMBODIMENTS

Figure 1:
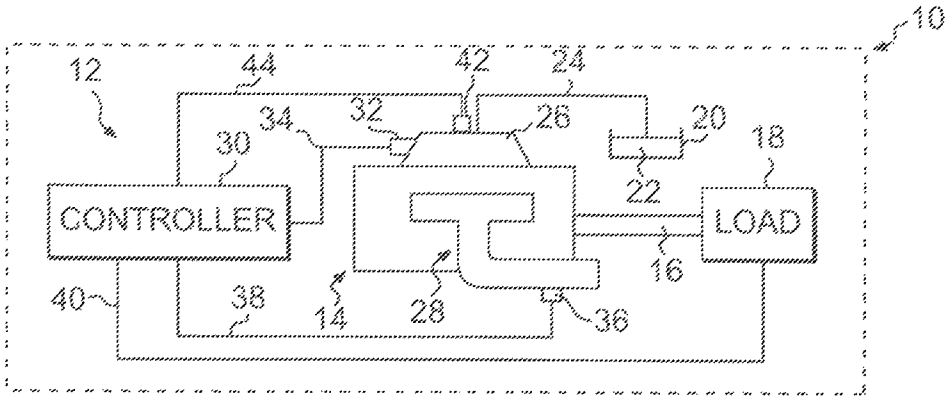
FIG. 1 is a schematic view of an exemplary machine, including an exemplary embodiment of a system for controlling operation of an internal combustion engine.

Reference will now be made in detail to exemplary embodiments of the invention. Wherever possible, the same reference numbers are used in the drawings and the description to refer to the same or like parts.

FIG. 1 schematically depicts an exemplary embodiment of a machine 10, including an exemplary embodiment of a system 12 for controlling operation of an internal combustion engine 14 configured to supply power via a drive train 16 to counteract a load 18. The machine 10 may include any machine that includes an internal combustion engine. For example, the machine 10 may include, but is not limited to, any fuel-powered machines having at least one internal combustion engine used to counteract a load, such as, for example, blowers (e.g., leaf blowers), chain saws, chippers, shredders, earth augers, edgers, generators, compressors, hedge trimmers, lawn tractors, lawn mowers, log splitters, pressure washers, snow throwers, string trimmers, tillers, and cultivators. In addition, the machine 10 may include any land-borne vehicles, such as, for example, motorcycles, mopeds, motor scooters, three-wheeled vehicles, all-terrain vehicles, track-driven vehicles, military vehicles, agricultural vehicles, construction vehicles, mining vehicles, automobiles, trucks, and buses, and/or any rail-borne vehicles, such as, for example, trains and light rail vehicles. The machine 10 may also include any air vehicles, such as, for example, manned or un-manned air vehicles, such as airplanes, helicopters, and air vehicles sometimes referred to as "ultralights," and/or any water-borne vehicles, such as, for example, personal watercraft (e.g., personal watercraft sometimes sold under the trade name JETSKI®), boats, ships, submarines, and/or vehicles sometimes referred to as "amphibious vehicles."

According to some embodiments, the system 12 may be configured to control operation of any type of internal combustion engine 14, including, but not limited to, reciprocating piston-driven engines, rotary engines, gas turbine engines, spark-ignition engines, and/or compression-ignition engines, such as diesel engines. For example, some embodiments of the system 12 may be configured to control the air-to-fuel mixture ratio ("the air-fuel ratio" or AFR), the spark-ignition timing, and/or the fuel injection timing (e.g., for a compression-ignition engine).

According to the exemplary embodiment depicted in FIG. 1, the machine 10 includes a reservoir 20 for containing a supply of fuel 22, which is in flow communication with internal combustion engine 14 via fuel line 24. The fuel may be, for example, gasoline, diesel fuel, alcohol such as methane and ethane, and/or combinations thereof, such as, for example, E85.

According to some embodiments, internal combustion engine 14 includes an intake system 26 configured to receive air and fuel 22 and mix the air and fuel 22 being supplied to the internal combustion engine 14 for combustion. For example, the intake system 26 may include a carburetor and/or one or more fuel injectors for supplying fuel to a combustion chamber (e.g., of a cylinder) of the internal combustion engine 14. According to some embodiments that include one or more carburetors, the carburetor(s) may operate to provide a supply of fuel and a supply of air to an intake manifold in flow communication with one or more combustion chambers of the internal combustion engine 14. According to some embodiments that include one or more fuel injectors, the fuel injector(s) may inject fuel into an intake manifold and/or directly into one or more combustion chambers, where the fuel may mix with air and ignite.

The exemplary embodiment schematically-depicted in FIG. 1 includes an exhaust system 28 configured to provide a flow path for the by-products of combustion to exit the internal combustion engine 14. For example, the exhaust system 28 may include one or more exhaust manifolds operably coupled to the internal combustion engine 14 (e.g., an internal combustion engine having two or more rows or banks of cylinders may include two or more exhaust manifolds operably coupled to the internal combustion engine), along with one or more exhaust pipes in flow communication with the exhaust manifold(s). The exhaust system 28 may include any portion of the internal combustion engine 14 located downstream of the combustion chamber, including, but not limited to, an exhaust portion of an engine cylinder head, an exhaust manifold, an exhaust pipe, a catalytic converter, and/or a particulate filter (e.g., for a compression-ignition engine).

According to the embodiment depicted in FIG. 1, the system 12 configured to control operation of the internal combustion engine 14 includes a controller 30 and one or more sensors 32 configured to send signals indicative of ambient conditions associated with the air entering the internal combustion engine 14 to the controller 30 via a communication link 34. For example, the one or more sensors 32 may be configured to send signals indicative of, for example, air temperature, air pressure, and/or air-mass-per-charge (AMPC). Such sensors may include, but are not limited to, mass airflow (MAF) sensors and/or manifold-absolute-pressure (MAP) sensors. Although FIG. 1 schematically depicts a sensor 32 directly coupled to the intake system 26, the sensor(s) 32 may not necessarily be directly coupled to the intake system 26. For example, the sensor(s) 32 may be operably coupled to any part of the machine 10 and/or may be located remotely from the machine 10. According to some embodiments, the communication link 34 may be a physical connection, such as, for example, a wire or fiber optic link, and/or a wireless link.

The controller 30 may include one or more processors, microprocessors, central processing units, on-board computers, electronic control modules, and/or any other computing and control devices known to those skilled in the art. The controller 30 may be configured run one or more software programs or applications stored in a memory location, read from a computer-readable medium, and/or accessed from an external device operatively coupled to the controller 30 by any suitable communications network.

The exemplary embodiment depicted in FIG. 1 includes one or more exhaust gas temperature (EGT) sensor(s) 36 configured to send signals indicative of the exhaust gas temperature during operation of the internal combustion engine 14 to the controller 30 via a communication link 38. Although the temperature sensor 36 depicted in FIG. 1 is shown coupled directly to the exhaust system 28, the temperature sensor(s) 36 may be operably coupled to the machine 10 at any location, so long as the temperature sensor(s) 36 are able to send a signal indicative of the exhaust gas temperature of the internal combustion engine 14. For example, the temperature sensor(s) 36 may include a thermocouple operably coupled to a portion of the exhaust system located anywhere downstream of a combustion chamber of the internal combustion engine 14. For example, the temperature sensor 36 may be operably coupled to a portion of the internal combustion engine 14 located adjacent to and downstream of the combustion chamber, such as an exhaust portion of a head, an exhaust manifold, an exhaust pipe, a catalytic converter, and/or a particulate filter. According to some embodiments, the temperature sensor(s) 36 may be located physically remote from the exhaust system 28 if, for example, the temperature sensor(s) 30 are optical devices, such as, for example, optical pyrometers and/or an infrared detection devices. According to some embodiments, the communication link 38 may be a physical connection, such as, for example, a wire or fiber optic link, and/or a wireless link. According to some embodiments, if engine 14 includes more than one cylinder, one or more temperature sensors 36 may be associated with each cylinder, so as to provide signals indicative of exhaust gas temperature from each cylinder to controller 30.

As schematically-depicted in FIG. 1, the controller 30 is configured to receive signals indicative of the operating conditions (OC) of engine 14 during operation. For example, the operating conditions may correlate to engine speed and/or air-mass-per-charge, and system 12 may include sensors for sending signals indicative of engine speed and/or air-mass-per-charge to controller 30 via a communication link, such as, for example, a wire or fiber optic link, and/or a wireless link. According to some embodiments, the controller 30 is configured to receive signals indicative of load 18 on the machine 10 via a communication link 40. Although the communication link 40 is depicted as being physically coupled to the load 18, the signals indicative of the load 18 may be provided from other portions of the machine 10. For example, the signals indicative of the load 18 may be provided from one or more portions of the drive train 16, for example, from an output shaft of the internal combustion engine 14, and/or an input and/or output shaft portion of a transfer case and/or transmission. According to some embodiments, a signal indicative of the load 18 may be provided by an engine speed sensor and/or a throttle position sensor. According to some embodiments, the communication link 40 may be a physical connection, such as, for example, a wire or fiber optic link, and/or a wireless link.

The exemplary embodiment depicted in FIG. 1 includes a control module 42 operably coupled to the controller 30 via a communication link 44. According to some embodiments, the control module 42 may be configured to control at least one of the air-fuel ratio entering one or more of the combustion chambers of the internal combustion engine 14, the ignition timing, and/or timing of the fuel delivery to one or more of the combustion chambers. For example, the control module 42 may be configured to control operation of one or more devices configured to control the air-fuel ratio, such as, for example, one or more carburetors and/or fuel injectors.

According to some embodiments, the control module 42 may include a device configured to control the ignition timing (i.e., for spark-ignition engine), such as, for example, a distributor and/or an electronic ignition system. According to some embodiments, the control module 42 may include a device for controlling the timing of the delivery of fuel to the one or more combustion chambers and/or the amount of fuel delivered to the one or more combustion chambers. The communication link 44 may be a physical connection, such as, for example, a wire or fiber optic link, and/or a wireless link.

Figure 2:
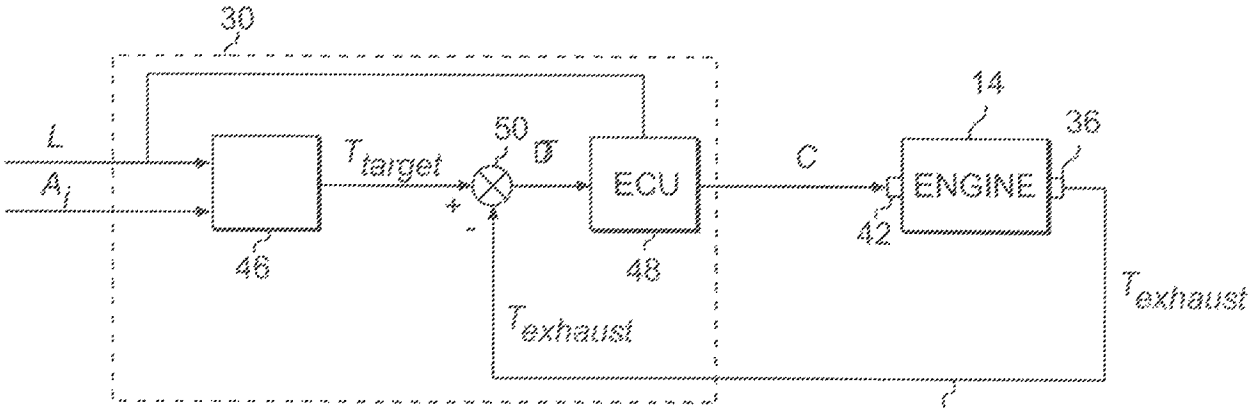
FIG. 2 is a block diagram of an exemplary embodiment of a system for controlling operation of an internal combustion engine.

Referring to the exemplary embodiment depicted in the block diagram of FIG. 2, some embodiments of the system 12 include a controller 30 configured to receive a number of signals and output one or more signals to the internal combustion engine 14, such that the efficiency is improved and/or such that the emissions are reduced. For example, the controller 30 may include a storage device 46 configured to store a plurality of tables and/or maps of data correlating, for example, at least one of load 18 on the internal combustion engine 14, operating conditions of the internal combustion engine 14, and/or exhaust gas temperature, and at least one of the air-fuel ratio, ignition timing, and fuel injection timing.

Figure 3:
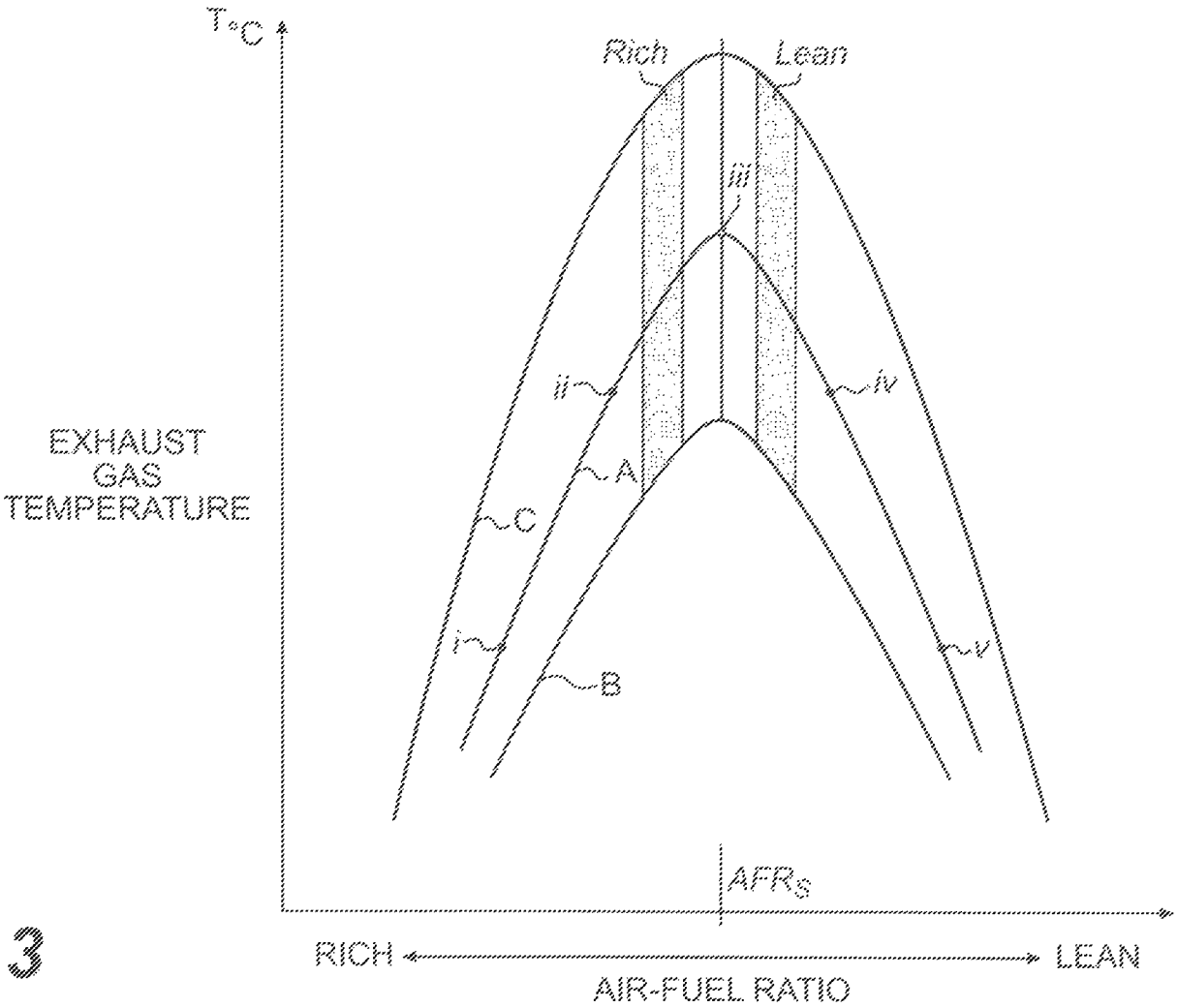
FIG. 3 is a graph of exemplary exhaust gas temperature curves associated with exemplary engine operating conditions or loads.

For example, referring to FIG. 3, the tables and/or maps of data may include data points on the exemplary graph shown in FIG. 3, which relate the exhaust gas temperature of the internal combustion engine 14 for given operating conditions at differing air-fuel ratios ranging from rich combustion (i.e., more fuel per unit air than theoretical, stoichiometric combustion (i.e., where there is just enough air for the fuel to completely combust)) to lean combustion (i.e., less fuel per unit air than theoretical, stoichiometric combustion).

As depicted in FIG. 3, for a given operating condition of the internal combustion engine 14, curve A depicts the exhaust gas temperature in relation to the air-fuel ratio. On the left-most portion (e.g., at point i) of curve A, at a relatively rich mixture ratio, the exhaust gas temperature is relatively low. As the air-fuel ratio is increased, reducing the relative richness of the air-fuel ratio, the exhaust gas temperature increases, for example, as depicted at point ii on curve A. As the air-fuel ratio approaches the theoretical, stoichiometric ratio $AFR_s$, the exhaust gas temperature reaches a maximum point iii on curve A for the given load on the internal combustion engine 14. As the air-fuel ratio continues to increase such that there is more air than necessary to completely burn the all of the fuel at point iv, the exhaust gas temperature begins to drop. As the air-fuel ratio continues to increase to an even leaner mixture at point v, the exhaust gas temperature drops even further.

If the operating conditions are reduced (e.g., the engine speed and/or air-mass-per charge is reduced) relative to the operating conditions represented by curve A, the relationship between the air-fuel ratio and the exhaust gas temperature may be represented by curve B, which indicates a general reduction in exhaust gas temperature for a given air-fuel ratio. If, on the other hand, the operating conditions are increased relative to the operating conditions depicted in curve A, the relationship between the air-fuel ratio and the exhaust gas temperature may be represented by curve C, which indicates a general increase in exhaust gas temperature for a given air-fuel ratio.

According to some embodiments, the air-fuel ratio depicted in FIG. 3 may be replaced by the ignition timing and/or the timing of the fuel injection into the combustion chamber. For example, in a spark-ignition engine, for a given operating condition and a given air-fuel ratio, changing the ignition timing from early to late may result in changing the exhaust gas temperature of the internal combustion engine 14. For example, if the ignition timing is relatively earlier than a timing that may result in complete combustion of the fuel (i.e., the optimum, stoichiometric ignition timing), the result may be a relatively lower exhaust gas temperature. As the ignition timing is progressively delayed up until the optimum ignition timing, the exhaust gas temperature may increase until reaching a peak at the point of optimum ignition timing. Conversely, as the ignition timing is delayed past the optimum ignition timing, the exhaust gas temperature may be reduced.

In a similar manner, for a compression-ignition engine, timing of the fuel injection into the combustion chamber may also impact the exhaust gas temperature. For example, when the fuel is injected into the combustion chamber earlier than the time at which the most complete combustion would occur (i.e., the optimum, stoichiometric injection timing), the exhaust gas temperature may be relatively low. As the injection timing is progressively delayed up until the optimum injection timing, the exhaust gas temperature may increase until reaching a peak at the point of optimum injection timing. Conversely, as the injection timing is delayed past the optimum injection timing, the exhaust gas temperature may be reduced.

According to some embodiments, the controller 30 may be configured to control the operation of the internal combustion engine 14 in a manner related to the relationship between the exhaust gas temperature and at least one of the air-fuel ratio, ignition timing, and fuel injection timing. For example, the storage device 46 may include tables and/or maps of the correlations between exhaust gas temperature and at least one of air-fuel ratio, ignition timing, and fuel injection timing in relation to different operating conditions of the internal combustion engine 14. According to some embodiments, rather than (or in addition to) the maps and/or tables, the storage device 46 may include equations representing the relationships between the exhaust gas temperature and at least one of the air-fuel ratio, ignition timing, and fuel injection timing in relation to different operating conditions of the internal combustion engine 14.

According to some embodiments, the controller 30 may be configured to control at least one of the air-fuel ratio, ignition timing, and fuel injection timing, such that the internal combustion engine 14 operates in relation to curves, for example, as shown in FIG. 3. For example, the controller 30 may be configured to control operation of the internal combustion engine 14, such that for a given operating condition, the exhaust gas temperature is located substantially at a predetermined point along a curve that represents a correlation between at least one of air-fuel ratio, ignition timing, and fuel injection timing. For example, the controller 30 may be configured to control at least one of the air-fuel ratio, ignition timing, and fuel injection timing, such that for a operating condition of the internal combustion engine 14, the exhaust gas temperature is at its maximum for the operating condition, regardless of the operating condition.

According to some embodiments, the controller 30 may be configured to control at least one of the air-fuel ratio, ignition timing, and fuel injection timing, such that internal combustion engine 14 performs with certain desired characteristics based on, for example, certain operational situations. For example, under some circumstances, it may be desirable for the internal combustion engine 14 to be relatively more responsive to changes in the operating condition or load 18 at the expense of, for example, efficiency.

According to some embodiments of internal combustion engine 14, the internal combustion engine 14 may tend to be more responsive to changes in operating condition or load when operating with an air-fuel ratio relatively more rich than the theoretical, stoichiometric mixture ratio $AFR_s$. Thus, in operational situations where it may be desirable to operate the internal combustion engine such that is relatively more responsive to changes in operating condition or load, it may be desirable to select a mixture ratio slightly rich of the theoretical, stoichiometric mixture ratio $AFR_s$. Conversely, under some operational situations, it may be desirable for the internal combustion engine 14 to be relatively more efficient at the expense of, for example, responsiveness to changes in operating condition or load. According to some embodiments of internal combustion engine 14, the internal combustion engine may tend to be more efficient when operating with a mixture ratio relatively more lean than the theoretical, stoichiometric mixture ratio $AFR_s$. Thus, in operational situations where it may be desirable to operate more efficiently, it may be desirable to select a mixture ratio slightly lean of the theoretical, stoichiometric mixture ratio $AFR_s$.

According to some embodiments, the controller 30 may be configured to control operation of the internal combustion engine 14 to achieve desirable operational characteristics in relation to certain operational situations. For example, if it is desirable to operate the internal combustion engine 14 in a manner that results in improved responsiveness to changes in operation conditions or load, the controller 30 may be configured to control at least one of the air-fuel ratio, ignition timing, and fuel injection timing, such that the internal combustion engine 14 operates slightly rich of the theoretical, stoichiometric mixture ratio $AFR_s$. If it is desirable to operate the internal combustion engine 14 in a manner that results improved efficiency, the controller 30 may be configured to control at least one of the air-fuel ratio, ignition timing, and fuel injection timing, such that the internal combustion engine 14 operates slightly lean of the theoretical, stoichiometric mixture ratio $AFR_s$.

According to some embodiments, the controller 30 may be configured to control the relative richness and/or leanness of the combustion by receiving a signal indicative of the exhaust gas temperature $T_{exhaust}$ via one or more sensor(s) 36 and communication link 38, and controlling at least one of the air-fuel ratio, ignition timing, and fuel injection timing, such that the exhaust gas temperature that correlates to the desired air-fuel ratio for a given operation condition or load is substantially achieved. Referring to FIG. 2, for example, the controller 30 may be configured to receive a signal indicative of the ambient conditions $A_i$ (i.e., the ambient temperature and/or ambient air pressure) associated with the intake system 26 and/or the operation conditions or load associated with the internal combustion engine 14. The controller 30 may be configured to determine a target exhaust gas temperature $T_{target}$ via the storage device 46 based on at least one of the ambient conditions $A_i$, operation conditions, and a load signal L. For example, for a given operation condition, the controller 30 may use the data from a look-up table, map, and/or equation of the correlation between exhaust gas temperature $T_{exhaust}$ and at least one of air-fuel ratio, ignition timing, and fuel injection timing to determine a target exhaust gas temperature $T_{target}$.

Once the target exhaust gas temperature $T_{target}$ has been provided, the controller 30 may be configured to send a control signal to an electronic control unit (ECU) 48, which, in turn, may send a control signal C via communication link 44 to the control module 42, which may be configured to control at least one of the air-fuel ratio, ignition timing, and fuel injection timing of the internal combustion engine 14 to achieve the target exhaust gas temperature $T_{target}$. According to some embodiments, the ECU 48 may be, for example, a single lever power controller. For example, the single lever power controller may be similar to single lever power controllers disclosed in commonly-assigned U.S. Pat. Nos. 6,171,055, 6,340,289, and 7,011,498, the subject matter of which is incorporated herein by reference. The use of other types of ECUs is contemplated. The one or more sensor(s) 36 provide(s) a signal indicative of the actual exhaust gas temperature $T_{exhaust}$, which is sent to controller 30 via communication link 38. The controller 30 compares via, for example, a comparator 50, the actual exhaust gas temperature $T_{exhaust}$ to the target exhaust gas temperature $T_{target}$. If a difference $\Delta T$ of more than a predetermined deadband (i.e., within a certain range of the target exhaust gas temperature $T_{target}$) around the target exhaust gas temperature $T_{target}$ exists, the difference $\Delta T$ is communicated to the ECU 48, which sends a signal to the control module 42 in order to adjust at least one of the air-fuel ratio, ignition timing, and fuel injection timing in order to more closely achieve the target exhaust gas temperature $T_{target}$.

Following the adjustment, the one or more sensor(s) 36 send a signal indicative of the actual exhaust gas temperature $T_{exhaust}$ to, for example, the comparator 50 of the controller 30. According to some embodiments, the comparator 50 may be configured to determine whether the actual exhaust gas temperature $T_{exhaust}$ is within the deadband of the target exhaust gas temperature $T_{target}$. If the exhaust gas temperature $T_{exhaust}$ is not within the deadband, the controller 30 determines whether the last adjustment made by the control module 42 resulted in the current actual exhaust gas temperature $T_{exhaust2}$ being closer to the target exhaust gas temperature $T_{target}$ than the previously measured actual exhaust gas temperature $T_{exhaust1}$. If the current actual exhaust gas temperature $T_{exhaust2}$ is closer to the target exhaust gas temperature $T_{target}$, then the ECU 48 sends a signal to the control module 42 to adjust at least one of the air-fuel ratio, ignition timing, and fuel injection timing in the same direction as the previous adjustment. If, on the other hand, the current actual exhaust gas temperature $T_{exhaust2}$ is farther from the target exhaust gas temperature $T_{target}$ than the previously measured exhaust gas temperature $T_{exhaust1}$, the ECU 48 sends a signal to the control module 42 to adjust at least one of the air-fuel ratio, ignition timing, and fuel injection timing in the opposite direction. This comparison between the current actual exhaust gas temperature $T_{exhaust2}$ and the previously measured exhaust gas temperature $T_{exhaust1}$ may be desirable, since each measured exhaust gas temperature may correspond to two distinct air-fuel ratio settings, ignition timing settings, and/or fuel injection timing settings. As a result, based on which side of stoichiometric combustion (e.g., at $AFR_s$) the exhaust gas temperature curve the settings lie, the adjustment of the air-fuel ratio, ignition timing, and/or fuel injection timing may result in a change in the actual exhaust gas temperature $T_{exhaust}$ in a direction opposite (i.e., higher instead of lower, or lower instead of higher) the desired direction. The controller 30 continues this closed-loop exhaust gas temperature comparison process until the actual exhaust gas temperature $T_{exhaust}$ is within the deadband of the target exhaust gas temperature $T_{target}$. Once within the deadband, the controller 30 continues to the comparison process to substantially maintain the actual exhaust gas temperature $T_{exhaust}$ within the deadband of the target exhaust gas temperature $T_{target}$.

According to some embodiments, as one or more of the ambient conditions, operating conditions, and signal indicative of load 18 changes, the controller 30 changes the target exhaust gas temperature $T_{target}$ in relation to the look-up tables, maps, and/or equations in the storage device 46. For example, as the ambient temperature associated with the air entering the intake system 26 increases, the target exhaust gas temperature $T_{target}$ provided by the controller 30 may tend to increase. Conversely, as the ambient temperature decreases, the target exhaust gas temperature $T_{target}$ provided by the controller 30 may tend to decrease. Further, as the operating conditions of the engine 14 increase (e.g., the engine speed and/or air-mass-per-charge increases), the target exhaust gas temperature $T_{target}$ provided by the controller 30 may tend to increase, whereas when the operating conditions decrease, the target exhaust gas temperature $T_{target}$ provided by the controller 30 may tend to decrease. According to some embodiments, as the load on the internal combustion engine 14 increases, the target exhaust gas temperature $T_{target}$ provided by the controller 30 may tend to increase, whereas when the load on the internal combustion engine 14 decreases, the target exhaust gas temperature $T_{target}$ provided by the controller 30 may tend to decrease.

According to some embodiments, the signal indicative of load L may change due, at least in part, to a number factors. For example, as schematically-depicted in FIG. 2, the ECU 48 may provide information related to the load 18. For example, the load 18 may relate to engine speed and/or throttle position (or air-mass-per-charge), and the ECU 48 may be configured to supply signals indicative of the engine speed and/or throttle position. For example, as the engine speed increases, the load 18 may generally increase. Further, as the throttle position increases, the load 18 may generally increase.

According to some embodiments, other factors may be contribute to the signal indicative of load L. The machine 10 may, for example, include a manual adjustment configured to alter the operating characteristics of the internal combustion engine 14. For example, the manual adjustment may provide an operator of the machine 10 with the ability to alter the operation of the internal combustion engine 14 to operate more responsively to changes in load and/or operate more efficiently. The manual adjustment may permit, for example, selection of a "power" mode and/or an "efficiency" mode. In the "power" mode, for example, the controller 30 may be configured to set the target exhaust gas temperature $T_{target}$, such that the resulting air-fuel ratio is at least slightly richer than the theoretical, stoichiometric mixture ratio $AFR_s$. An operator might be inclined to select the exemplary "power" setting when the machine 10 is, for example, an air vehicle that is about to take-off or land. Selecting the exemplary "power" mode setting might result in a higher power output and/or increased responsiveness of the internal combustion engine 14. In the "efficiency" mode, for example, the controller 30 may be configured to set the target exhaust gas temperature $T_{target}$, such that the resulting air-fuel ratio is at least slightly leaner than the theoretical, stoichiometric mixture ratio $AFR_s$. An operator might be inclined to select the exemplary "efficiency" mode when the machine 10 is, for example, an air vehicle that has reached cruising altitude and is flying at a relatively steady cruising speed and/or a relatively steady altitude. Selecting the exemplary "efficiency" mode setting may result in improved fuel efficiency.

According to some embodiments, a signal indicative of the exemplary mode settings may contribute to the signal indicative of the load L, such that the controller 30 sets the target exhaust gas temperature $T_{target}$ accordingly. Once the target exhaust gas temperature $T_{target}$ has been set, it may be desirable for the controller 30 to adjust at least one of the air-fuel ratio, ignition timing, and fuel injection timing such the internal combustion engine 14 operates on the side of the theoretical, stoichiometric mixture ratio $AFR_s$ (i.e., relatively rich or relatively lean of stoichiometric), since the actual exhaust gas temperature $T_{exhaust}$ coincides with two mixture ratios for each given load, one mixture ratio rich of the theoretical, stoichiometric mixture ratio $AFR_s$ and one mixture ratio lean of the theoretical, stoichiometric mixture ratio $AFR_s$ (see FIG. 3). For example, the controller 30 may be configured to receive a signal indicative of the current actual exhaust gas temperature $T_{exhaust2}$ and compare it to the previously-measured exhaust gas temperature $T_{exhaust1}$. Based on whether the adjustment to the air-fuel ratio, ignition timing, and/or fuel injection timing resulted in increasing or decreasing the current exhaust gas temperature $T_{exhaust2}$, and whether the air-fuel ratio was increased or decreased, the ignition timing was delayed or advanced, and/or the fuel injection timing was delayed or advanced, the controller 30 determines which side of the theoretical, stoichiometric mixture ratio $AFR_s$ (i.e., rich or lean of stoichiometric) the current actual exhaust gas temperature $T_{exhaust2}$ falls.

According to some embodiments, the controller 30 may be configured to determine whether to operate the internal combustion engine 14 rich of stoichiometric combustion, substantially at stoichiometric combustion, or lean of stoichiometric combustion based on operating parameters related to the machine 10. For example, if the throttle position is greater than a certain percentage of full throttle (e.g., greater than about 80% of full throttle), the controller 30 may be configured to provide a target exhaust gas temperature $T_{target}$ that is at least slightly rich of stoichiometric combustion for the given load 18, which may increase the responsiveness and/or power of the internal combustion engine 14. If, on the other hand, the throttle position is less than a certain percentage of full throttle (e.g., less than about 35% of full throttle), the controller 30 may be configured to provide a target exhaust gas temperature $T_{target}$ that is at least slightly lean of stoichiometric combustion for the given load 18, which may increase the efficiency of the internal combustion engine 14. If the throttle position is within a certain intermediate range of full throttle (e.g., more than about 35% but less than about 80% of full throttle), the controller 30 may be configured to provide a target exhaust gas temperature $T_{target}$ that provides substantially stoichiometric combustion for the given load 18. Similarly, according to some embodiments, if the engine speed is greater than a certain engine speed, the controller 30 may be configured to provide a target exhaust gas temperature $T_{target}$ that is at least slightly rich of stoichiometric combustion for the given load 18. If, on the other hand, the engine speed is less than a certain engine speed, the controller 30 may be configured to provide a target exhaust gas temperature $T_{target}$ that is at least slightly lean of stoichiometric combustion for the given load 18. If the engine speed falls within a certain intermediate range of possible engine speeds, the controller 30 may be configured to provide a target exhaust gas temperature $T_{target}$ that provides substantially stoichiometric combustion for the given load 18. According to some embodiments, the ECU 48 may be configured to provide signals indicative of at least one of the throttle position and engine speed to the controller 30.

Some embodiments of the controller 30 may be configured to factor fluctuations in the signal indicative of the load L (or a relative lack of fluctuations) into a determination of the target exhaust gas temperature $T_{target}$. For example, the controller 30 may be configured to set a target exhaust gas temperature $T_{target}$ that results in operation of the internal combustion engine 14 at least slightly rich of stoichiometric if, for example, the signal indicative of load L fluctuates more than a certain amount, which may result in a desire for the internal combustion engine 14 to operate in a manner that is relatively more responsive to changes in the load 18 on the internal combustion engine 14. Conversely, the controller 30 may be configured to set a target exhaust gas temperature $T_{target}$ that results in operation of the internal combustion engine 14 at least slightly lean of stoichiometric if, for example, the signal indicative of load L remains below a certain threshold amount of fluctuation, which may result in a desire for the internal combustion engine 14 to operate in a manner that is relatively more efficient.

The look-up tables and/or maps of the correlations between exhaust gas temperature and at least one of air-fuel ratio, ignition timing, and fuel injection timing, may be generated via a combination of theoretical calculation and empirically-derived data. For example, thermodynamic theory may be used to determine projected exhaust gas temperatures for stoichiometric combustion based on ambient air conditions, chemical energy associated with the air-fuel ratio, and an estimated amount of work produced by combustion of the air-fuel ratio, which may correlate to the operating condition of the engine and/or the magnitude of the load 18 on the engine. Such theoretical calculations may be based on, for example, enthalpy calculations. Further, such calculations may be performed for a number of different values for one or more of the ambient air conditions, chemical energy associated with the air-fuel ratio, and the estimated amount of work to determine exhaust gas temperatures associated with stoichiometric combustion for the changed value sets.

According to some embodiments, the exhaust gas temperatures calculated based on thermodynamic theory may be used as a reference point for empirically-deriving actual exhaust gas temperature data while operating an actual internal combustion engine on a test bed, such as, for example, a dynamometer, and recording the actual data points associated with its operation upon changing the ambient air conditions and the amount of actual work produced by the internal combustion engine 14. For example, the exhaust gas temperature can be recorded as at least one of the air-fuel ratio, ignition timing, fuel injection timing, operating condition (e.g., engine speed and/or air-mass-per-charge), and load 18 on the internal combustion engine 14 is/are changed. This process may be used to produce the look-up tables, maps, and or equations for storage in the storage device 46, which may be used by the controller 30. According to some embodiments, the empirical analysis may be performed with or without performing the theoretical thermodynamic analysis. Further, according to some embodiments, the data points, regardless of how they are determined, may be represented by mathematical equations, and the controller 30 may be configured to control operation of the internal combustion engine 14 by using the mathematical equations rather than (or in addition to) using the look-up tables and/or maps.

Figure 4:
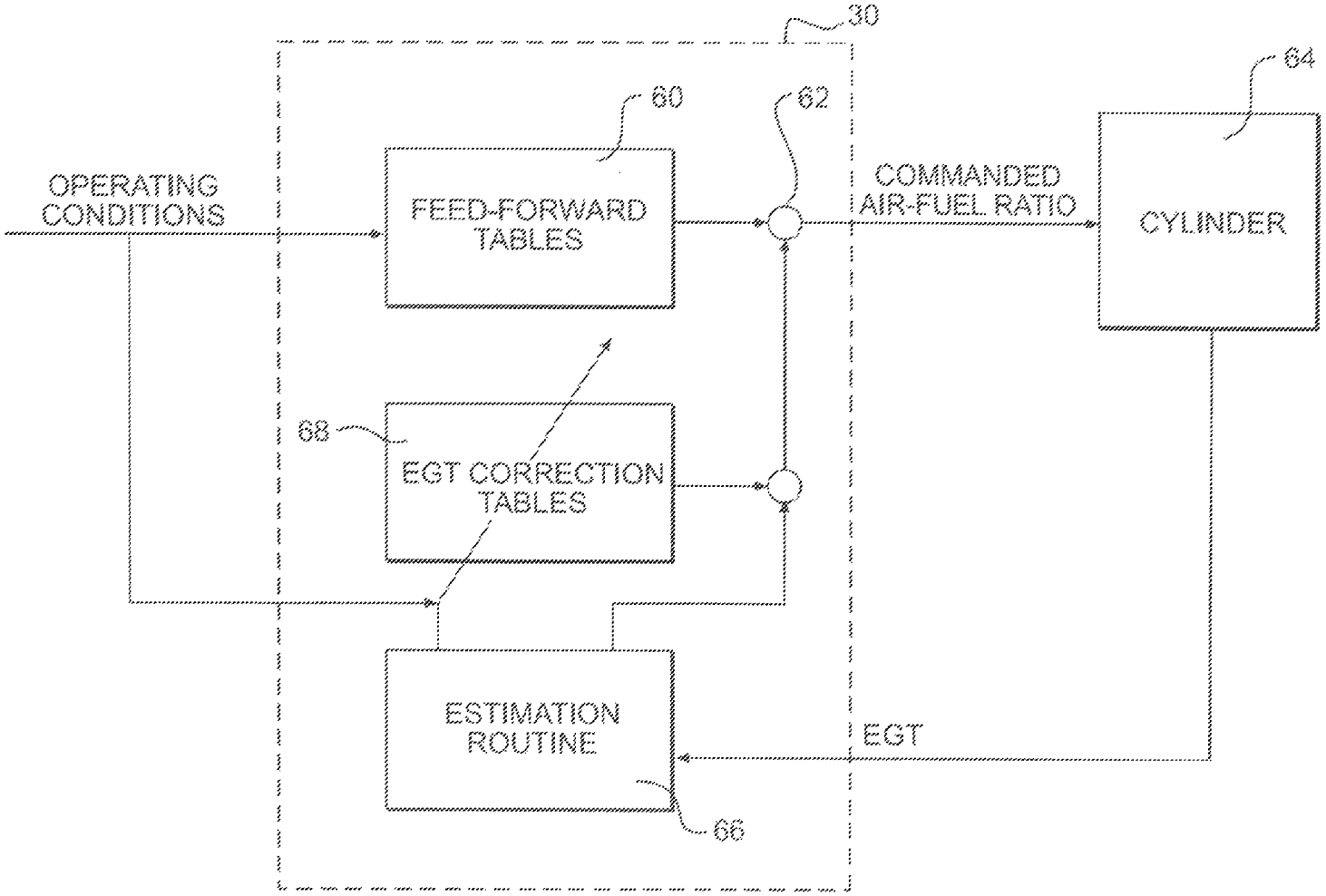
FIG. 4 is a block diagram of an exemplary embodiment of a system for controlling operation of an internal combustion engine.

In the exemplary embodiment of system 12 shown in FIG. 4, the exemplary system 12 may combine open-loop, feed-forward operation with closed-loop, feedback operation. For example, the exemplary system 12 may include a controller 30 configured to operate according to the block diagram shown in FIG. 4. For example, the controller 30 may be configured to operate the engine 14 by receiving operating conditions (e.g., engine speed and/or air-mass-per-charge) and selecting an air-fuel ratio for operating the engine 14 from at least one of look-up tables, maps, and/or equations that correlate the operating conditions, air-fuel ratio, and exhaust gas temperature, from feed-forward tables denoted by block 60. Based on the correlations from the feed-forward tables, at node 60 a command air-fuel ratio is provided to operate a cylinder 64 of the engine 14. In this exemplary manner, the engine 14 is operated in a feed-forward, open loop manner.

However, due to, for example, engine wear, sensor degradation, and/or fuel differences, the feed-forward correlations in block 60 may not be as accurate as desired. Thus, the commanded air-fuel ratio provided at block 60 may not be as accurate as desired, possibly resulting in a loss of efficiency and/or power during operation of the engine 14.

The exemplary controller shown in FIG. 4 also includes a closed-loop, feedback control to determine correction factors for the correlations in feed-forward tables. The exemplary closed-loop, feedback control may facilitate correction or update of the correlations in the feed-forward tables and/or detection of system component errors/failures.

For example, as shown in FIG. 4, controller 30 is configured to perform an estimation routine at block 66 once the engine 14 reaches steady-state operating conditions. The estimation routine is configured to estimate the commanded air-fuel ratio ("the peak air-fuel ratio") that coincides with the peak exhaust gas temperature for a given operating condition. This, in turn, may be used to generate correction factors that may be stored in exhaust gas temperature correction tables, maps, and or equations denoted by block 68. The correction factors are associated with the operating condition during which the estimation routine is preformed, and thus, in the future when the engine 14 is operated at similar or substantially the same operating condition, the correction factors associated with that operating condition may be used to correct the commanded air-fuel ratio generated by the feed-forward tables at block 60. This may facilitate improved control of the engine 14, so that it may operate more efficiently and/or with more power.

According to some embodiments, during the estimation routine, the commanded air-fuel ratio is swept (e.g., adjusted through a range of air-fuel ratio settings) to compare to correlate the air-fuel ratios with actual exhaust gas temperatures determined by the exhaust gas temperature sensor. The data points generated from the estimation routine can be used to generate an air-fuel ratio vs. exhaust gas temperature curve, as explained in more detail with respect to FIG. 5. This curve may be compared for the operating conditions against a nominal curve based on air-fuel ratio and exhaust gas temperature data obtained from the feed-forward tables. Any discrepancy between these two curves may be used to determine correction factor, which may be added to the commanded air-fuel ratio to ensure that the correct air-fuel ratio matches the target air-fuel ratio. These correction factors may be stored to memory in the EGT correction tables and may be used in future when the engine 14 is operating according to the same operating conditions.

Exemplary operation of the estimation routine is explained below in the context of general aviation. In an airplane, a pilot may manually set the air-fuel ratio by first determining the peak of the exhaust gas temperature profile during steady-state flight conditions. Once the peak EGT is determined, the AFR may be adjusted up or down to set for lean operation of the engine 14, for example, based on a known offset from the peak EGT that may be provided by, for example, the engine manufacturer.

The exemplary system 12 may operate to automate the pilot's actions. For example, the system 12 may include a steady-state detection function that identifies steady-state flight conditions and initiates the estimation routine, which adjusts the air-fuel ratio through a range of different air-fuel ratios, so that the estimation routine can determine the peak exhaust gas temperature and the air-fuel ratio ("the peak air-fuel ratio") that corresponds to the peak exhaust gas temperature. The estimation routine determines where the peak EGT and peak air-fuel ratio occurs and stores them in two-dimensional look-up tables (e.g., in the EGT correction tables). According to some embodiments, the estimation routine is repeated for one or more cylinders (e.g., for each cylinder) of the engine 14 in a coordinated, sequential manner.

For example, during operation, the system 12 may first determine whether steady-state conditions exist. When steady-state conditions are detected, the estimation routine is performed on a first cylinder of engine 14. Once the estimation routine has been completed for the first cylinder, the estimation routine is preformed on a second cylinder of engine 14, and this sequence is repeated for a number of cylinders of the engine 14 (e.g., all of the cylinders of engine 14).

Once the estimation routine has been performed on the cylinders, the results of the estimation routine may be clipped based on the mean and variance of the results for the cylinders to ensure that consistent corrections across all of the cylinders, and all of the EGT correction tables may be updated to reflect a change in air-fuel ratio between the initially commanded air-fuel ratio from the feed-forward tables.

While still at the same operating condition of engine 14, the estimation routine may be performed again, beginning with a cylinder other than the first cylinder on which the estimation routine was initially performed. At this performance of the estimation routine, the target air-fuel ratio is adjusted by the change in air-fuel ratio determined and stored during the performance of the previous estimation routine. This results in a new commanded air-fuel ratio, and the sequence described above may be repeated for all the cylinders subjected to the estimation routine.

According to some embodiments, the performance of estimation routine is suspended if the system determines that the engine 14 is no longer operating at steady-state conditions. If the estimation routine is suspended, the system continues to store the correction factors in the EGT correction tables, and the corrected air-fuel ratio commands are used during operation of the engine 14 whenever the estimation routine is inactive. According to some embodiments, the estimation routine is performed with a slow slew rate on the feed-forward correction to prevent a step change in the air-fuel ratio command when the estimation routine is suspended.

According to some embodiments, the system 12 is configured to determine whether the engine 14 is operating at steady-state based on one or more of throttle position, air-mass-per-charge, exhaust gas temperature, and engine speed. Because exhaust gas temperature is expected to change during the estimation routine and feedback control, settled exhaust gas temperature may be used as a condition to enter steady-state, but not to leave it. According to some embodiments, steady-state is determined only at operating conditions where the air-fuel ratio to exhaust gas temperature responsiveness is sufficient for the estimation routine to work. Such conditions may be stored in a tables, and once steady state conditions are detected, they may be maintained for 15 seconds before steady-steady is conformed for commencement of the estimation routine.

According to some embodiments, a pilot may disable the estimation routine by changing the throttle position, which will change the operating condition. Following suspension of steady-state, a predetermined time lapse (e.g., 10 seconds) may be required prior to a determination of a new steady-state condition.

During a cylinder test of the estimation routine, the air-fuel ratio for the tested cylinder is commanded using a series of steps (e.g., seven steps) at different air-fuel ratio levels. For each air-fuel ratio step, the commanded air-fuel ratio is held long enough for the associated exhaust gas temperature to settle for accurate measurement. The duration of each step may be based on the operating condition of the engine 14 and may vary. For example, the duration of the step may vary between about 12 and 18 seconds. The detected exhaust gas temperature at each step may be used to construct an air-fuel ratio vs. exhaust gas temperature curve for the estimation of the peak exhaust gas temperature and associated peak air-fuel ratio.

According to some embodiments, the estimation routine will begin with the air-fuel ratio target set equal to the commanded air-fuel ratio from the feed-forward tables. The next two steps will be in the rich direction (i.e., a smaller air-fuel ratio). If the exhaust gas temperature initially drops and thereafter increases, the first data point (i.e., the target air-fuel ratio) is dropped. This prevents the estimation routine from tracking to the lean exhaust gas peak that may typically occur between air-fuel ratio values of 1.2 and 1.3. Subsequent steps will locate the peak exhaust gas temperature by taking air-fuel ratio steps of, for example, increments of 0.1.

As the estimation routine increases the air-fuel ratio by increments, absolute air-fuel ratio limits of, for example, 0.75 minimum and 1.15 maximum are enforced along with relative air-fuel ratio limits about the previous peak estimate of the air-fuel ratio. If during the estimation routine, the commanded air-fuel ratio achieves either the minimum or maximum air-fuel ratio limits, or the estimation routine predicts that the search direction is away from the peak exhaust gas temperature, the search direction will be reversed. According to some embodiments, if the search direction is reversed, the step size is reduced to provide finer resolution in the commanded air-fuel ratio vs. exhaust gas temperature curve. This may tend to provide more data points near the peak, which permits improved estimation of the peak exhaust gas temperature and peak air-fuel ratio.

Once the sweep is completed for a given cylinder, a routine may be applied to determine the peak exhaust gas temperature and peak air-fuel ratio. According to some embodiments, a series of checks may be performed to verify the validity of the peak estimation. If the peak estimation is performed for more than one cylinder, the peak estimates may be checked for consistency. If an estimated peak for one cylinder is judged inconsistent with the peak estimate for the other cylinders, it may be clipped to be closer to the mean peak estimate of the other cylinders. Upon completion of the estimation routine, the change in peak estimate for the air-fuel ratio may be saved as a correction factor in the exhaust gas temperature correction table. Thereafter, the correction factor may be applied to the values of the feed-forward tables.

Figure 5:
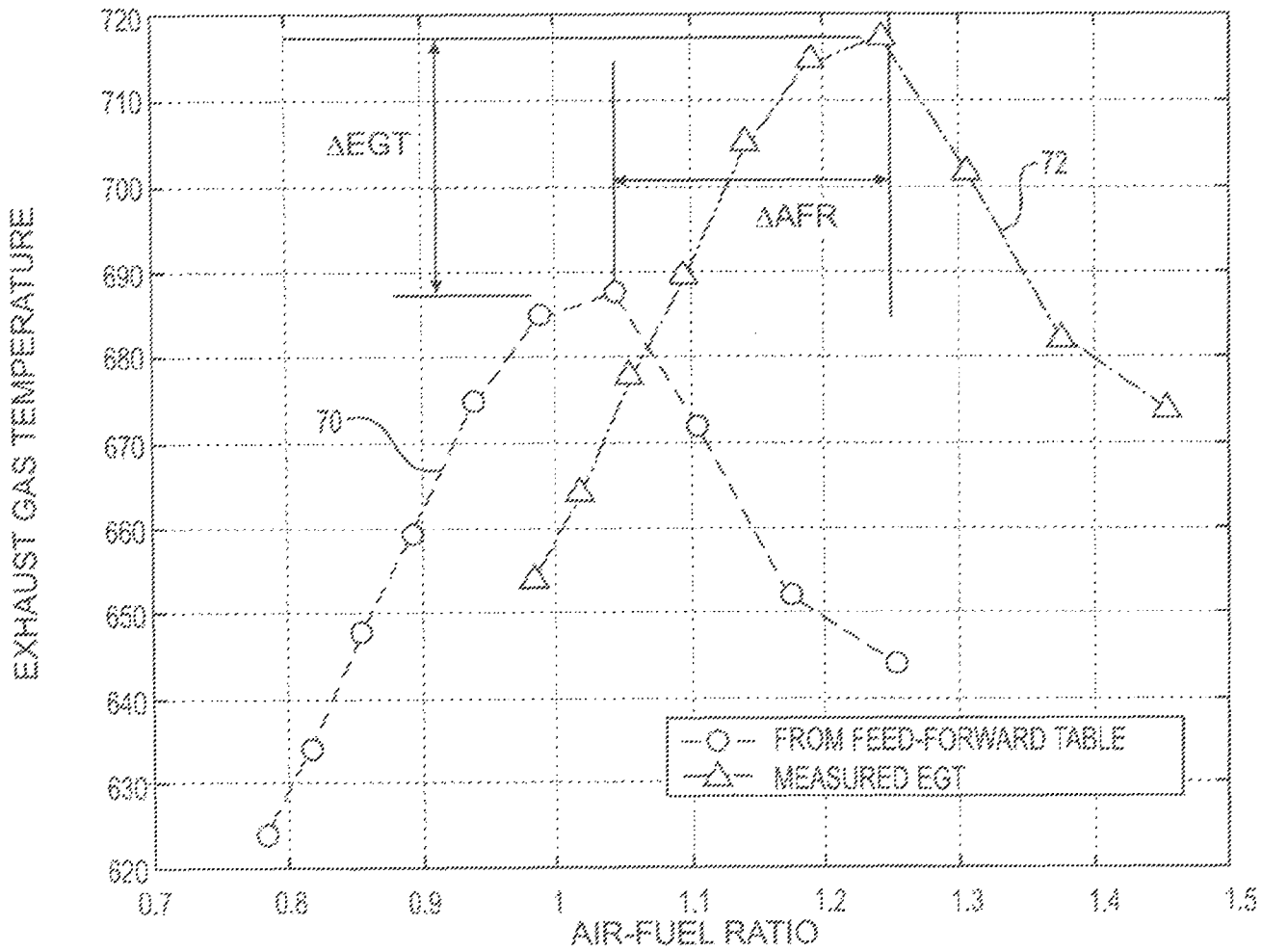
FIG. 5 is a graph of exemplary exhaust gas temperature curves associated with exemplary air-fuel ratios for a given engine operating condition.

FIG. 5 shows a graph of air-fuel ratio vs. exhaust gas temperature. Curve 70 in FIG. 5 is based on data obtained from the feed-forward tables of air-fuel ratio and corresponding exhaust gas temperature for a given operating condition of engine 14. Curve 72 is based on air-fuel ratio and corresponding exhaust gas temperature data obtained during the estimation routine for the same operating condition of engine 14. According to some embodiments, the system 12 is configured to generate an equation for the curve 72 based on the exhaust gas temperatures associated with each of the air-fuel ratios. This equation may be used to estimate a peak exhaust gas temperature and/or a corresponding peak air-fuel ratio, with the peak exhaust gas temperature corresponding to a point at which the slope of the curve 72 is zero. The equation may be generated by known mathematical methods, such as, for example, a weighted least-squares curve fit.

As shown in FIG. 5, the curves 70 and 72 differ from one another, and thus, the peak exhaust gas temperatures and peak air-fuel ratios of the two curves differ by ΔEGT and ΔAFR, respectively. The differences between the data associated with curve 70 and curve 72 may be used to determine the correction factors, which may be stored in the EGT correction tables. The correction factors are associated with the operating condition (e.g., engine speed and/or air-mass-per-charge) of the engine 14. Thus, any time the engine is operated at substantially the same operating condition, the commanded air-fuel ratio from feed forward tables may be adjusted according to the correction factors for the given operating condition stored in the EGT correction tables.

According to the example shown in FIG. 5, the commanded air-fuel ratio must be adjusted relative to the commanded values to about 1.25 to achieve the peak exhaust gas temperature. The difference between curve 70 and curve 72 shows that the feed-forward tables may be less accurate than desired, and thus, the peak estimate of air-fuel ratio is off by about 0.25. However, the accuracy may be improved by the closed-loop feedback aspect of the exemplary system 12.

According to some embodiments, the system 12 may be configured for fault detection. For example, exhaust gas temperature may be used to detect injector failure or sensor error. For example, based on exhaust gas temperature, one or more of the following failure modes may be detected: the EGT sensor has shorted to ground, the EGT sensor has shorted to power, the EGT sensor has shorted to wire harness, the EGT sensor has malfunctioned, the fuel injector remains open, the fuel injector remains closed, and the fuel injector provides incorrect fuel metering.

For example, EGT sensor faults/failures may be detected by monitoring the measured exhaust gas temperature. If the EGT sensor fails, the system may disable the estimation routine for the cylinder associated with the failed sensor. The EGT-based fault/failure detection for the fuel injector for the affected cylinder may also be disabled. According to some embodiments, if the sensor shorts to ground or the power supply, the EGT may immediately jump to a limit value. If the EGT falls outside minimum or maximum limits, the sensor may be identified as having failed.

According to some embodiments, the measurement function of an EGT sensor may be continuous. In such case, if the EGT change between cycles of the sensor exceeds a pre-determined limit, then the sensor may be identified as having failed.

In-range sensor failures may be detected by computing the difference of each EGT measurement from the mean of all other healthy EGT measurements. This value, or EGT offset, may be compared against several thresholds to detect sensor and/or injector failures. A cylinder may be deemed to have a healthy EGT measurement if its sensor has not failed, and that cylinder has not run any injector diagnostic tests within a predetermined time (e.g., within the past 30 seconds). According to some embodiments, one failed sensor may cause large EGT offsets for all cylinders of the engine. Thus, it may be desirable to evaluate only the healthy cylinder with the largest EGT offset. This restriction may serve to prevent one failure from triggering false alarms on other cylinders.

According to some embodiments, the EGT offset may be compared (i.e., substantially continuously) against two coarse thresholds, a maximum coarse EGT threshold and a minimum coarse EGT threshold. Exceeding the maximum coarse EGT threshold indicates a sensor failure, whereas exceeding the minimum coarse EGT threshold may indicate a sensor or injector failure.

According to some embodiments, while operating in steady state, changes to EGT offset may be compared against finer thresholds, a maximum finer threshold and a minimum finer threshold. The EGT offset of all cylinders is latched upon entering steady state, and thereafter these finer thresholds are active while no cylinder is performing the estimation routine. The latched values may also be invalidated if the failure status of any sensor or injector changes within the current steady state event. In such case, only the coarse EGT thresholds may be enforced.

According to some embodiments, each fuel injector may be supplied with fuel via two injector lanes. For such embodiments, during normal operation, the two injector lanes share control of the fuel metering, such that each of the two injector lanes inject about half of the fuel during a combustion cycle. However, the system 12 may be configured to alter this distribution of fuel in response to injector failures, or to facilitate identification of injector failures.

According to some embodiments, if no injector failures are detected, the system operates according to a default fuel distribution for the two injector lanes. If, however, an injector lane failure occurs, then the system 12 may alter the fuel distribution such that the non-failed injector lane supplies all of the fuel for the affected cylinder. According to some embodiments, even though only a single injector lane is operational, the estimation routine may still be performed based on whether the system detects steady-state operation of the engine 14. According to some embodiments, the system 12 may be configured to cut-off fuel supply to a cylinder when neither injector lane is operational.

As noted above, an EGT offset below the minimum coarse EGT threshold may indicate either a failed sensor or a failed injector. To identify the failed subsystem, the controller 30 may trigger an injector lane test. For example, if on any cylinder, the change in peak air-fuel ratio differs by more than a predetermined amount from the mean values of other cylinders, then an injector lane test may be preformed for that cylinder. As with the check on EGT offset, only the cylinder with the largest EGT offset may fail. This behavior is based on the assumption that only one cylinder will fail at a time, and that the one failed cylinder could induce false-positives when comparing the results of other cylinders to a mean value.

A low exhaust gas temperature measurement identifies either a sensor or fuel injector failure. According to some embodiments, the system 12 may be configured to identify the failed subsystem by commanding fuel from each injector lane independently, while monitoring exhaust gas temperature. If measured exhaust gas temperature is much higher when using a single injector, then the other injector is failed, while the high-EGT injector and EGT sensor are healthy. If, on the other hand, there is no exhaust gas temperature differential when switching between lanes, or the exhaust gas temperature is low for both injectors, then a failed EGT sensor may be the cause. A failed-open injector may also trigger this response, and therefore, be labeled as a sensor failure. As the system 12 may not have the ability to rectify a failed-open injector, this behavior is acceptable.

The mode of operation of the system 12 during an injector lane test may be dependent upon the triggering event. For example, if low-exhaust gas temperature is detected while the estimation routine is inactive, then the system 12 may operate each injector lane independently for a short time period. The EGT offset may be saved at the end of the time period, and thereafter the two offset values may be compared to determine which lane is operating properly. If exhaust gas temperature is significantly higher when using a single injector, then the other injector is identified as having failed. If there is a negligible exhaust gas temperature difference between injector lanes, then the sensor is identified as having failed.

If low exhaust gas temperature is detected during performance of the estimation routine, then each injector lane is commanded to sweep through the full range of air-fuel ratios. The minimum EGT offset for each injector lane may be determined, beginning a predetermined time into the sweep (e.g., several seconds into the sweep). These values for each injector lane may thereafter be compared to determine which injector lane is healthy. The controller 30 will identify the sensor as having failed if there is a negligible exhaust gas temperature difference between the two injector lanes.

According to some embodiments, an out-of-range change in air-fuel ratio peak result on any given cylinder may also trigger the diagnostic air-fuel ratio sweep. For example, if during an estimation routine the change in air-fuel ratio peak for a cylinder is significantly different than the change in air-fuel ratio peak for other cylinders, the diagnostic air-fuel ratio sweep may be performed. It may be assumed that if an injector has a large enough fuel-metering bias to trigger this test, then it will cause the cylinder to misfire at some point within the sweep. Thus, the injector lane with a lower minimum EGT offset during the sweep may be identified as having failed. Unlike the lane tests triggered by a low exhaust gas temperature, an inconclusive lane test due to out-of-range air-fuel ratio peak does not result in identifying an EGT sensor failure.

It will be apparent to those skilled in the art that various modifications and variations can be made to the structures and methodologies described herein. Thus, it should be understood that the invention is not limited to the subject matter discussed in the specification. Rather, the present invention is intended to cover modifications and variations.

What is claimed is:

1. A system for controlling operation of an internal combustion engine, the system comprising:

a control module configured to control at least one of an air-fuel ratio, a spark-ignition timing, and a fuel injection timing of the internal combustion engine;

a sensor configured to generate a signal indicative of exhaust gas temperature; and a controller configured to:

determine a desired mode of operation of the internal combustion engine as improved responsiveness, stoichiometric combustion, or improved fuel efficiency;

based on a given load and speed of the internal combustion engine, determine a target exhaust temperature corresponding to the desired mode of operation;

command the control module to set at least one of the air-fuel ratio, the spark-ignition timing, and the fuel injection timing based on the target exhaust temperature before determining a difference between the target exhaust temperature and the signal indicative of the exhaust gas temperature; and command the control module to adjust the at least one of the air-fuel ratio, the spark-ignition timing, and the fuel injection timing based on the difference between the target exhaust gas temperature and the signal indicative of the exhaust gas temperature.

2. The system of claim 1, further comprising a storage device configured to store at least one of a map, a look-up table, and an equation relating the given load and speed of the internal combustion engine and the target exhaust gas temperature to the at least one of the air-fuel ratio, the spark-ignition timing, and the fuel injection timing, wherein the controller is configured to determine how to set the at least one of an air-fuel ratio, a spark-ignition timing, and a fuel injection timing by reference to the at least one of the map, the look-up table, and the equation.

3. The system of claim 1, wherein the controller is further configured to:

automatically select the desired mode of operation based on a known application of the internal combustion engine; and select the desired mode of operation based on manual input received from a user of the system.

4. A system for controlling operation of an internal combustion engine, the system comprising:

a control module configured to control an air-fuel ratio of the internal combustion engine;

a storage device configured to store at least one of a map, a look-up table, and an equation correlating a given load, speed, and desired mode of operation of the internal combustion engine to a target exhaust temperature;

a sensor configured to generate signals indicative of an exhaust gas temperature of the internal combustion engine; and a controller configured to:

reference the least one of the map, the look-up table, and the equation to determine the target exhaust temperature;

command the control module to set the air-fuel ratio of the internal combustion engine based on the target exhaust gas temperature;

command the control module to adjust the set air-fuel ratio to a plurality of different air-fuel ratios;

estimate a peak exhaust gas temperature based on the signals generated during adjustment from the set air-fuel ratio to the plurality of different air-fuel ratios; and update the correlation between the given load, speed, desired mode of operation and target exhaust gas temperature stored in the storage device based on the estimated peak exhaust gas temperature for future use in air-fuel ratio setting.

5. The system of claim 4, wherein the controller is further configured to command the control module to control operation of the internal combustion engine at each of the plurality of different air-fuel ratios for a predetermined period of time.

6. The system of claim 4, wherein the controller is configured to estimate the peak exhaust gas temperature by generating an equation based on the exhaust gas temperatures associated with each of the plurality of different air-fuel ratios.

7. The system of claim 4, wherein the controller is configured to determine when the internal combustion engine is operating at steady-state, and to command the control module to adjust the set air-fuel ratio to the plurality of different air-fuel ratios only when the engine is determined to be operating at steady-state, and wherein the controller is configured to determine whether the internal combustion engine is operating at steady-state based on at least one of a throttle position, an air-mass-per-charge, an exhaust gas temperature, and an engine speed.

8. The system of claim 4, wherein the internal combustion engine comprises a plurality of cylinders, and the sensor is one of a plurality of sensors configured to generate signals indicative of exhaust gas temperatures for each of the plurality of cylinders.

9. The system of claim 8, wherein the controller is configured to:

command the control module to separately adjust the air-fuel ratio of each of the plurality of cylinders to the plurality of air-fuel ratios; and estimate for each of the plurality of cylinders the peak exhaust gas temperature based on the signals generated during adjustment of the air-fuel ratio.

10. The system of claim 9, wherein the controller is further configured to:

determine a mean peak exhaust gas temperature based on the estimated peak exhaust gas temperature determined for each of the plurality of cylinders and make a comparison of the estimated peak exhaust gas temperature associated with each of the plurality of cylinders with the mean peak exhaust gas temperature; and determine whether one of the estimated peak exhaust gas temperatures is invalid based on the comparison.

11. A system for controlling operation of an internal combustion engine comprising at least one cylinder and at least one fuel injector for supplying fuel for combustion in the at least one cylinder, the system comprising:

a control module configured to control an air-fuel ratio of the an internal combustion engine;

a storage device configured to store at least one of a map, a look-up table, and an equation correlating a given load, speed, and desired mode of operation of the internal combustion engine to a target exhaust temperature;

a sensor configured to generate signals indicative of an exhaust gas temperature of the internal combustion engine; and a controller configured to:

command the control module to set the air-fuel ratio of the internal combustion engine based on the target exhaust gas temperature;

command the control module to adjust the set air-fuel ratio to a plurality of different air-fuel ratios;

determine whether there is a fault associated with operation of one of the sensor and the at least one fuel injector based on the signals generated during adjustment from the set air-fuel ratio to the plurality of different air-fuel ratios; and control the internal combustion engine responsive to the fault.

12. The system of claim 11, wherein the fault includes at least one of the following: the sensor has shorted to ground, the sensor has shorted to power, the sensor has shorted to wire harness, the sensor has malfunctioned, the at least one fuel injector remains open, the at least one fuel injector remains closed, and the at least one fuel injector provides incorrect fuel metering.

13. The system of claim 11, wherein the controller is configured to determine that the sensor has failed if the signal indicative of exhaust gas temperature is outside a minimum limit or a maximum limit.

14. The system of claim 11, wherein:

the engine comprises a plurality of cylinders and at least one fuel injector associated with each of the plurality of cylinders, and the sensor is one of a plurality of sensors configured to generate signals indicative of exhaust gas temperatures associated with operation of each of the plurality of cylinders, and the controller is configured to determine whether there is a fault associated with operation of one of the plurality of sensors and the at least one fuel injector associated with each of the plurality of cylinders based on the signals.

15. The system of claim 14, wherein the controller is configured to compare the signals generated by each of the plurality of sensors and, if one of the signals indicates a temperature outside a range of a mean of the temperatures associated with operation of others of the plurality of cylinders, the controller is configured to determine whether a fault exists with a corresponding one of the plurality of sensors or the at least one fuel injector associated with a corresponding one of the plurality of cylinders.

16. The system of claim 15, wherein the controller is further configured to compare the one of the signals to maximum and minimum coarse thresholds and maximum and minimum fine thresholds and, if the one of the signals is outside either the maximum or minimum coarse threshold, indicate failure of the corresponding one of the plurality of sensors.

17. The system of claim 14, wherein:

the internal combustion engine comprises two fuel injectors associated with each cylinder;

each of the two fuel injectors is configured to supply a portion of a total amount of fuel supplied to an associated one of the plurality of cylinders; and the controller is further configured to determine whether there is a fault associated with operation of one of the two fuel injectors, and responsively supply the total amount of fuel with a remaining one of the two fuel injectors.

* * * * *